United States Patent [19]

McCoy

[11] 4,153,245

[45] May 8, 1979

[54] GAME OF PHYSICAL SKILL

[76] Inventor: Kenneth H. McCoy, 11714 Goshen Ave., Los Angeles, Calif. 90049

[21] Appl. No.: 832,228

[22] Filed: Sep. 12, 1977

Related U.S. Application Data

[63] Continuation-in-part of Ser. No. 711,731, Aug. 5, 1976.

[51] Int. Cl.[2] ..... A63B 71/00

[52] U.S. Cl. ..... 273/1 R

[58] Field of Search ..... 273/1 R; 272/1 E, 92, 272/144–146; 404/34–46, 19, 20

[56] References Cited

U.S. PATENT DOCUMENTS

| | | | |
|---|---|---|---|
| 2,792,164 | 5/1957 | Cauffiel | 404/34 X |
| 3,718,329 | 2/1973 | Sabo | 273/1 R |
| 3,940,129 | 2/1976 | Franco | 273/1 R |

FOREIGN PATENT DOCUMENTS

| | | | |
|---|---|---|---|
| 1140297 | 1/1969 | United Kingdom | 273/1 R |

OTHER PUBLICATIONS

The Complete Book of Games, Wood & Goddard, p. 825, Tire Wrestling, Dec. 1940.

Readers Digest Book of 1000 Family Games, pp. 53 & 54, Tug of War, Jun. 1973.

*Primary Examiner*—Paul E. Shapiro

*Attorney, Agent, or Firm*—Carothers and Carothers

[57] ABSTRACT

A game of physical skill to be played by two or more persons wherein the participants each stand within their respective small and encompassing ground boundaries or on small portable platforms which hold them a slight distance off the ground. Each participant then grasps onto a hand line which is connected at an intermediate point to every other participant's hand line. Each participant starts with an extra length of hand line which is also provided with a plastic tube grip over the line for grasping the line therein and to permit effective controlled slipping of the line through the hands without friction burns. The object of the game is to unbalance all other participants such that they can no longer stay within their respective boundaries or on the platform, or in the alternative to dislodge the hand line away from all other participants. The respective ground boundaries may be marked on the ground surface, or provided by mats or raised platforms.

22 Claims, 9 Drawing Figures

GAME OF PHYSICAL SKILL

CROSS REFERENCE TO RELATED APPLICATION

This application is a continuation-in-part of application Ser. No. 711,731 filed Aug. 5, 1976.

BACKGROUND OF THE INVENTION

This invention relates generally to games and more particularly to games of physical skill wherein balance and coordination are required.

A well known game utilizing a hand line or rope is tug-of-war. In the game of tug-of-war, two or more participants grasp opposite sides of the hand line or rope and the object is to pull the other side over a center marker between the two sides of participants. This game requires muscle power and brute force, but little agility, balance or skill. It is the object of the present invention to provide a game utilizing a hand line wherein muscle power is one of the lesser requirements and more emphasis is placed upon individual physical coordination, balance and skill.

SUMMARY OF THE INVENTION

The game of the present invention is one of physical skill to be played by two or more persons. The game comprises a pair of encompassing standing boundaries which may be a continuous closed mark on the ground, such as a circle, a pair of mats, or a pair of spaced portable platforms capable of holding the weight of a human being a short distance off of a ground surface. The encompassing boundaries should be sufficiently large to permit a person to stand therein, but sufficiently small such that they also impart to the person standing therein a feeling that he must maintain his balance in order to remain standing within the boundaries or on the platform when subjected to unbalancing forces from an opposing player. The game of the present invention further incorporates a hand line to be grasped by persons standing on the platforms respectively. The hand line is of a length which is greater than the spacing between the boundaries or platforms so that each participant can grasp the line such that it is taut between the players and each player has reserve loose line for use during participation in the game.

Each participant is also provided with a short length of rigid or flexible plastic tubing that slidably fits over the hand line. If the tubing is rigid, the participant can stop slippage of the hand line through the rigid tubing by twisting the tube at sharp angles relative to the direction of pull of the hand line. If the tube is flexible, the participant grasps the tubing as a grip to tightly grip the hand line therein to prevent the hand line from slipping through the participant's hands. Also, in either case, the grip tubing is utilized to permit the participant to effectively control slipping of the hand line through the hands when desired without incurring friction burns on the hands. With the flexible tubing, the participant can control slippage or feedout of the hand line with a minimum of possible detection from other participants. Other slidable grip means may be substituted such as tubular slides with spring loaded jams that can be finger actuated.

More than two boundaries or platforms may be used. For example, if three or more boundaries or platforms are used, the hand line then consists of a hand line segment for each boundary or platform with one end of each line segment being joined together at a point intermediate the spaced boundaries or platforms. When three or more boundaries or platforms are used, each one is positioned such that it is out of alignment with the remaining boundaries, mats or platforms. For example, if four boundaries or platforms are being utilized, they would generally be positioned in four opposed quadrants of a circle.

The object of the game is to unbalance all other opposing players such that the opposing players are forced into a condition whereby they lose their balance and a portion of their body must touch the ground surface beyond the encircling or encompassing boundary in order to maintain their balance. The game is also won if the opposing player completely loses grasp of his hand line segment.

The object of the game is to not only attempt to unbalance the opposing player or players by pulling or jerking the hand line, but also unbalance the opposing player by suddenly permitting reserve hand line to slip through one's hand grasp or the plastic tubular grip at the precise moment an opposing player is jerking or pulling on the line. However, in this instance, if one should let all of his reserve line slip through his hands, he is then disqualified and out of the game. Also, if one loses his balance and must touch the floor or ground surface beyond the boundary, mat or platform, with any portion of his body in order to maintain his balance, he is also disqualified and out of the game, and the remaining players, if any, continue until one person or participant remains.

If platforms are utilized in conjunction with the game of the present invention, they may consist of platforms having circular or angular tops with an annular or angular perimetric and downwardly extending base to engage the ground surface. In addition, the top is provided with a plurality of spaced downwardly extending indentations, the bottoms of which touch the same ground surface. This provides a platform which may be inexpensively and easily molded of relatively thin plastic as a unitary piece and which will also easily support the weight of a heavy human being anywhere over its surface.

The platforms may also be conventional skate boards which are held stationary or permitted to be free wheeling to require additional balance skill of the participants. In this regard, the platforms may also be made unstable to require extra balance skill by providing the platforms with a longer center leg or a convex bottom so that they will teeter.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Figure 1:
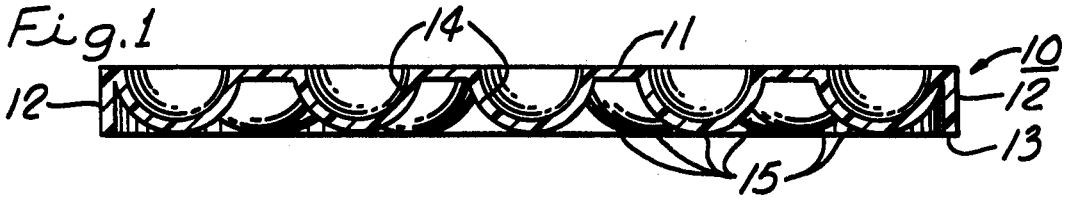
FIG. 1 is a sectional view in side elevation of one embodiment of the platform utilized in the game of the present invention, as seen along line 1—1 of FIG. 2.
Figure 2:
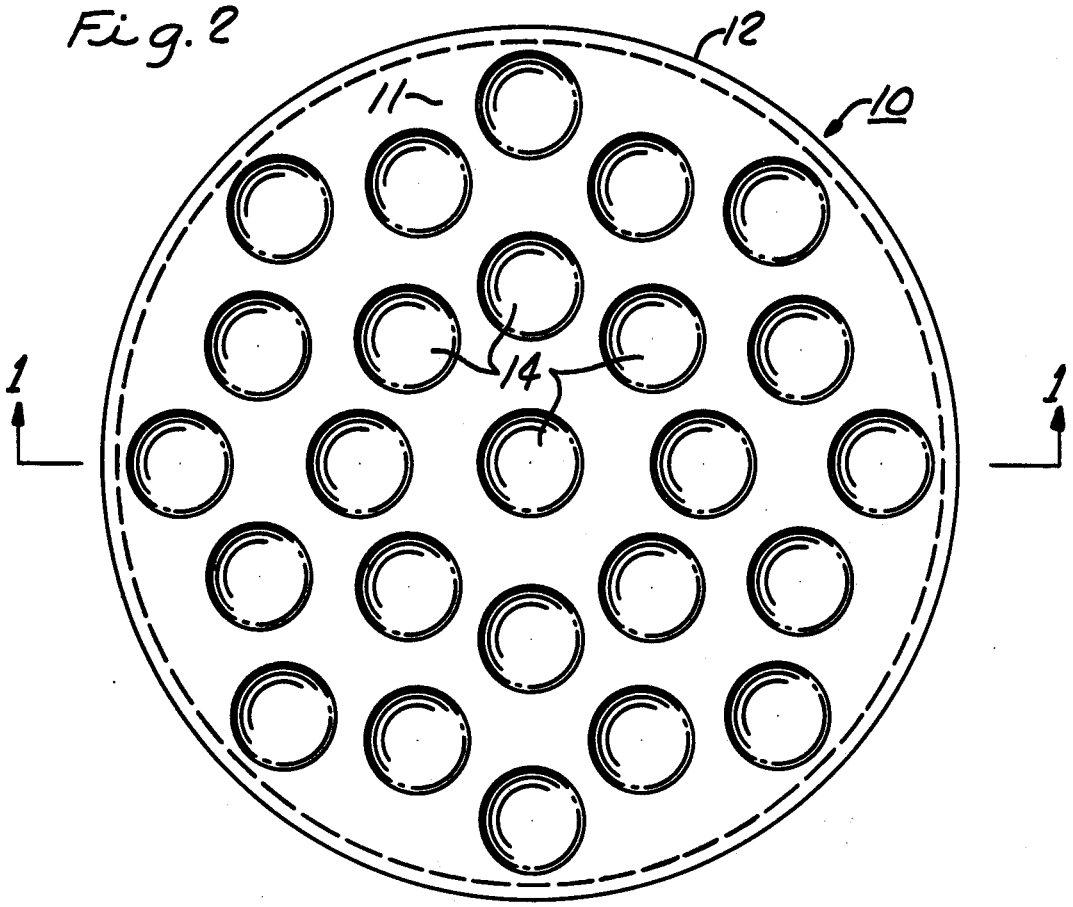
FIG. 2 is a plan view of the platform illustrated in FIG. 1.

Referring to FIGS. 1 and 2, the preferred embodiment of the platform 10 to be utilized in the game of the present invention is illustrated.

The platform 10 is integrally molded of a plastic material and consists of a circular top 11 which is provided with an annular perimetric and downwardly extending base 12, the bottom of which is to engage a ground surface which would be at the level of line 13.

Top 11 is provided with a plurality of spaced downwardly extending indentations 14 which form thereby a plurality of downwardly extending legs 15 underneath the top platform surface 11. The bottoms of these legs 15 also touch the ground surface. Thus, the platform 10 has a large number of points at which it contacts the ground surface on the underneath side and these contact points are widely distributed over the total area of the platform 10. This permits the platform to be molded unitarily with a minimum amount of plastic, yet provides a platform structure which is capable of holding the weight of a very heavy person.

The height of the platform off the ground surface is generally selected to be in the area of one-half inch to six inches, and the diameter of the platform is generally selected to be in the area of one to three feet. Typically, the platform would be four inches high and 16 inches in diameter.

The reason that the dimensions are selected in this general area is that it is desirable to maintain the platform as a portable item which is easily carried about by the smallest person, and in addition, the diameter should be such that both feet of the participant can be steadily positioned on the platform; and yet the platform should not be so large that the participant loses the sensation or feeling that he must be continually conscious of maintaining his balance to stay on the platform while participating in the game.

While the platform is preferably molded of plastic, it is also obvious that any other suitable material may be used such as metal or even a solid piece of wood. However, the platform construction illustrated is considered to be unique, as it is extremely light and inexpensive in construction.

Figure 3:
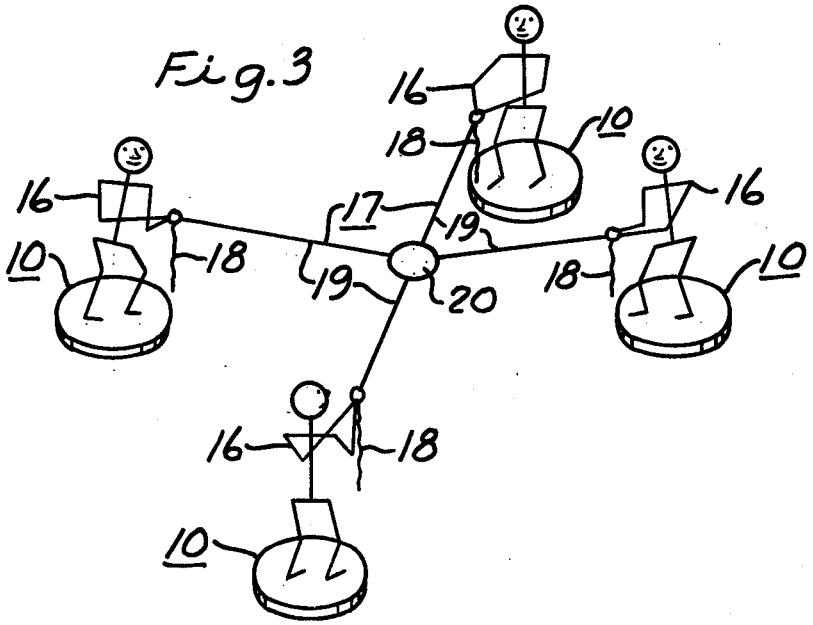
FIG. 3 is a diagrammatic stick figure view of the game of the present invention being carried out by participants.

Turning next to FIG. 3, a diagrammatic illustration of four individuals participating in the game of the present invention is given. In this illustration, four participants 16, illustrated in stick form, are engaging in the game of the present invention. The game pieces consist of the platforms 10, previously described, and a hand line 17 to be grasped by the participants standing on the platforms respectively. It should be noted that the hand line 17 extending between any two opposed platforms 10 has a length which is greater than the spacing between the platforms thereby leaving reserve hand line 18 for each participant. The same amount of reserve line 18 should be left for each player, and to this end, the hand line 17 may be marked at the point where the participants are to initially grasp the line when initiating the game.

It should also be noted that when more than two platforms are utilized in the game, each platform is positioned out of alignment with the remaining platforms. In other words, if three platforms were being utilized, all three platforms would not be positioned in a straight line. Preferably, with three or more platforms, the platforms would be equi-angularly positioned about the circumference of a circle. However, participants may wish to play in teams, and in this event, the participants illustrated in FIG. 3 would pair up such that opposing pairs of team platforms would be positioned more closely adjacent each other or in other words, teammate platforms 10 would be positioned next to each other. In addition, it is also obvious that team members may stand on the same platform grasping the hand line 17 together.

The hand line 17 consists of four hand line segments 19 which are joined together at one end at a point intermediate the spaced platforms as indicated at 20, which is a metal or plastic ring to which the line segments 19 are fastened. Line segments 19 are preferably fastened to the center ring 20 with a loop so that they will easily slide about ring 20.

The object of the game is to cause all opposing players either simultaneously or one at a time to lose their balance while standing on their respective platform 10 such that the opposing participant must touch the ground surface with any portion of his body in order to maintain his balance. This is done by continuous play action on the hand line 17 by jerking the line and also by unexpectedly giving slack in the line when an opposing player is attempting to pull on the same. Thus, it is not a game of sheer muscle force, and it is obvious that a small child with skill can unbalance even the largest of players.

When a participant pulls or jerks the hand line towards himself in an attempt to unbalance the opposing players, the opposing players may resist this force by pulling back, or they can attempt to throw him off balance by giving off slack in the line or permitting a portion of the reserve line 18 to slide through his hands. However, if any one participant permits all of the reserve line 18 to slip through his hands, then he is disqualified and out of the game in the same manner that he would be if he were caused to be off balance such that a portion of his body were to touch the ground surface.

In the alternative, once the game starts, participants may pull in as much line as they can and attempt to pull the line 17 entirely out of the hands of opposing players.

While at first glance it would seem that the game requires very little skill, upon actual participation it is quickly realized that this game takes a good deal of physical coordination, balance and physical agility, and further involves a good deal of mental participation in attempting to deceive one's opponent as to one's sequence of actions or movements he will make in order to unbalance the opponents or gain possession of the entire hand line 17.

The remaining participant who has not touched the ground surface with any portion of his body or who has gained possession of the entire hand line 17 is the winner.

Figure 4:
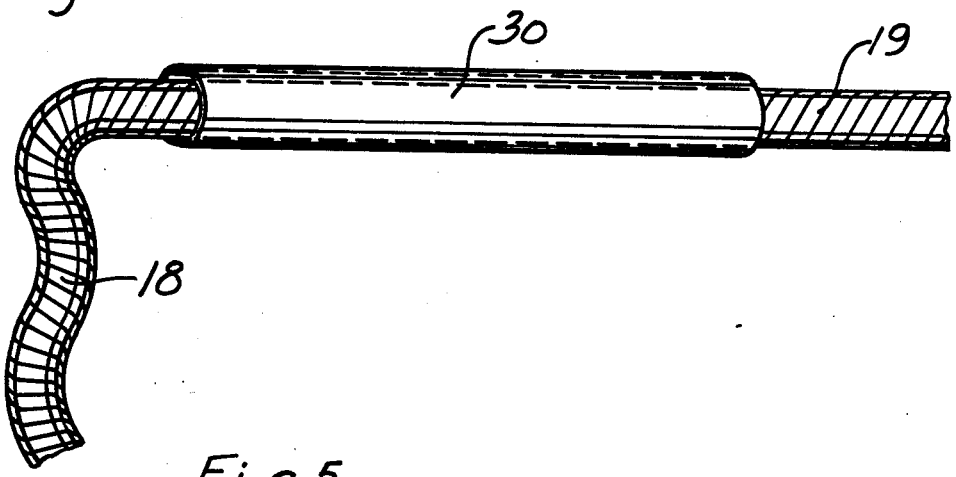
FIG. 4 is a side view of a section of the hand line utilized in the game of the present invention showing the short rigid or flexible plastic tube grip for grasping the hand line therein and permitting controlled slipping therethrough.

Referring to FIG. 4, the hand grip utilized by each of the participants is illustrated in detail. The hand grip 30 consists of a short tubular section of rigid or flexible plastic which is slidably received over the hand line segment 19.

Assuming the hand grip means is flexible, the participant grasps the grip 30 in one or both hands and can prevent the hand line segment 19 from slipping therethrough by tightly squeezing or grasping the plastic tubular grip 30. He can also permit the hand line segment 19 to quickly slip out through the tubular grip 30 by relieving the hand pressure on the outside of the tube. The amount of slippage can also be accurately and quickly controlled by the participant by regulating the outside hand grip pressure on tube 30. In addition, the participant's hands are not subject to rope or friction burns, as the hand line 19 does not come in direct slide contact with the hands.

When the participant desires to pull in a portion of hand line segment 19, he can grasp the line directly, pull it in, and thereafter slide tube 30 up to a new gripping position, or he can hold tubular grip 30 in one hand and grab reserve line 18 in the other and pull the hand line through the tubular grip 30 when he has a loose grip on the tubular grip 30 and then immediately grasp tubular grip 30 with a tight grip when he has pulled all the line possible for that moment of play.

If the hand grip means 30 is rigid pipe, slippage is controlled by twisting the pipe at different angles relative to the direction of the taut hand line 19.

Figure 5:
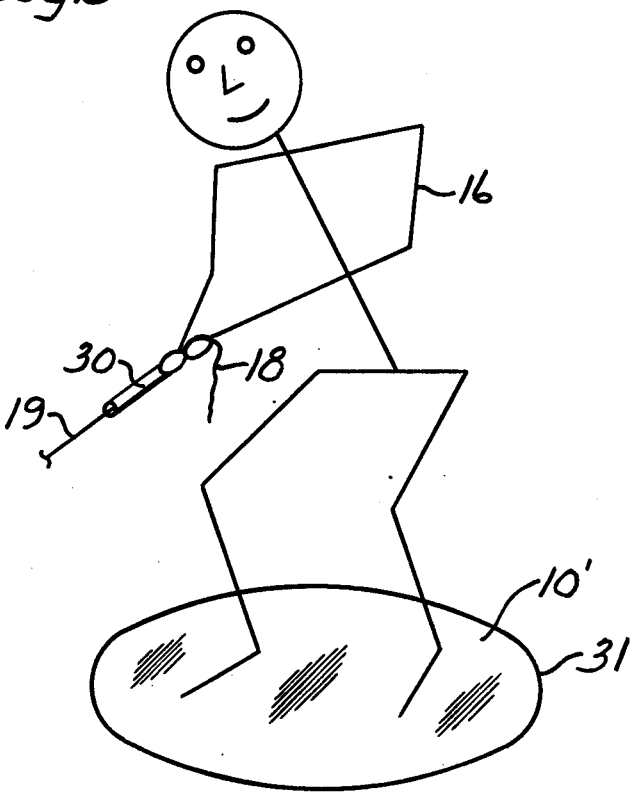
FIG. 5 is a diagrammatic stick figure view of one game participant standing on an encompassing ground mat boundary and grasping the tubular grip and hand line illustrated in FIG. 4.

FIG. 5 is a stick representation of a participant grasping the tubular grip 30 illustrated in FIG. 4. FIG. 5 also illustrates the participant 16 utilizing a thin mat 10' instead of a raised platform 10 as illustrated in FIGS. 1 through 3 to define the small encircling or encompassing standing boundary 31. This boundary can, of course, also be square or have some other angular configuration, but if it is a mere line, then it is enclosed or continuous.

The game is played in the same manner as before, except the standing boundary is not raised off of the ground level, as is the case in the illustration of FIG. 3.

Figure 6:
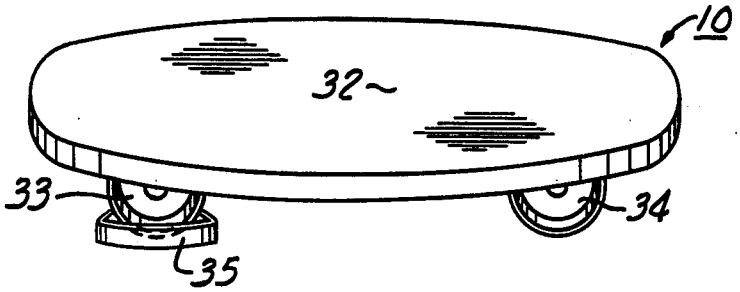
FIG. 6 is a perspective view of a skate board platform to be used as a part of the game of the present invention.

FIG. 6 is a perspective view of a variation in the platform 10 to be utilized with the game of the present invention. In this Figure, platform 10, on which the participant is to stand, is a conventional skate board 32 having front skate wheels 33 and rear skate wheels 34. By utilizing the skate board 32 as the platform 10 for the game of the present invention, additional skill of balance and agility is required of the participants in playing the game as afore-described. This is obviously because of the fact that the skate wheels 33 and 34 are free-wheeling and the platform is thus moveable. However, if it is desired to maintain the skate board platform 32 stationary while playing the game, small caster cups 35 may be provided to insert at least one of the skate wheels in order to hold the platform stationary in one position. Cup 35 may be manufactured of any suitable material such as hard rubber or plastic.

Figure 7:
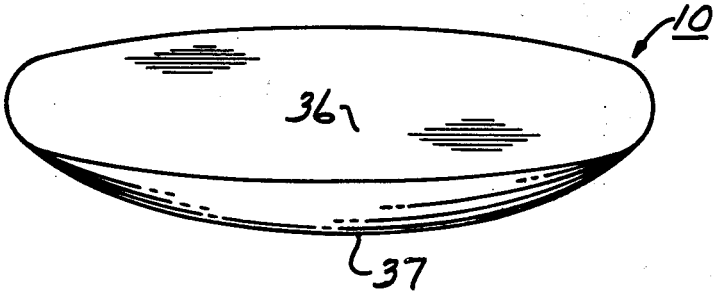
FIG. 7 is a perspective view of an oblong teeter platform to be used as a part of the game of the present invention.

FIG. 7 illustrates another embodiment variation of the platform 10. Here the platform 10 is in the shape of an oval or oblong top standing surface 36 and is provided with a rounded or convex bottom 37 so that the platform will teeter in all directions. As with the skate board platform 32 of FIG. 6, this requires additional agility and balance of the participants and adds further excitement to the game. Instead of providing the convex bottom 37 as illustrated, any conventional means may be employed to provide the teetering platform of FIG. 7, such as by utilizing a central leg support for the platform which is longer than any other leg or support member of the platform at its periphery to thus give a teetering action.

Figure 8:
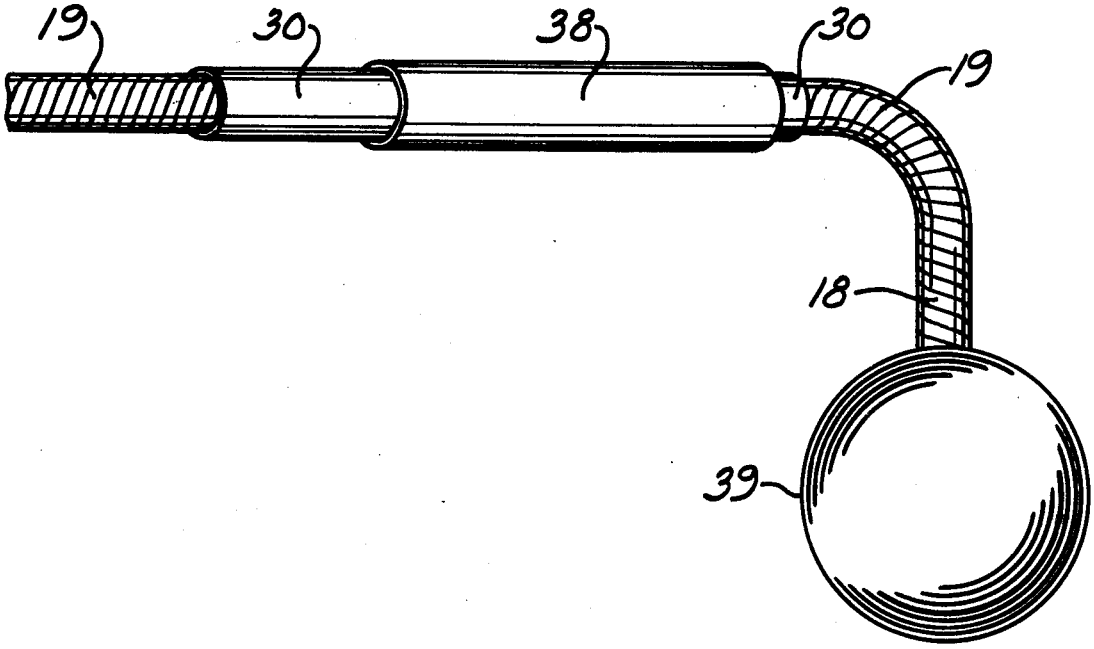
FIG. 8 is a side view of a section of the hand line utilized in the game of the present invention showing a short flexible tube in combination with a coaxially overlying rigid tube forming a grip for grasping the hand line therein and permitting controlled slipping therethrough.

Referring next to FIG. 8, yet another embodiment of the hand grip 30 is illustrated. Unlike the hand grip 30 in FIG. 4 which consists of a single tubular section of either flexible or rigid material, the hand grip illustrated in FIG. 8 consists of a flexible tubular hand grip section 30 in combination with a rigid tubular hand grip section 38 which is coaxially received over the flexible tubular section 30 and secured thereto as by glue.

This hand grip has the advantage that in order to grip the hand line segment 19 by way of the flexible tubular hand grip section 30, one need not grasp the flexible section or hand grip 30 directly, but rather may grasp the rigid tube section 38 and by turning the rigid tube section 38 at an angle relative to the direction of extension of line segment 19, rigid hand grip section 38 will thus quickly squeeze off underlying flexible hand grip 30 and grip the hand line segment 19 at the desired position. In order to permit additional hand line 19 to slip through the hand grip, the participant merely straightens out the rigid hand grip 38 in line with line segment 19. The participant may thus very quickly and accurately control line slippage and also have available an exposed portion of the flexible tubular hand grip 30 for additional direct hand manipulation if desired.

Also illustrated in FIG. 8 is a ball 39 of light foam material which is secured to the end of the reserve line 18. In playing the game, it is sometimes encountered that the reserve line 18 tends to whip about in a wild fashion. The foam ball 39 lessens any chance of personal injury due to this whipping action. However, the use of the foam ball 39 does have a disadvantage in that the reserve line 18 cannot slip entirely through hand grip 30 due to the attached ball, unless ball 39 is made so that it can be readily dislodged from and reattached to the reserve line 18 by the slippage of the line through the hand grip, yet sufficiently secured to the reserve line 18 otherwise such that ordinary whipping of the reserve line 18 does not dislodge the foam ball 39.

Figure 9:
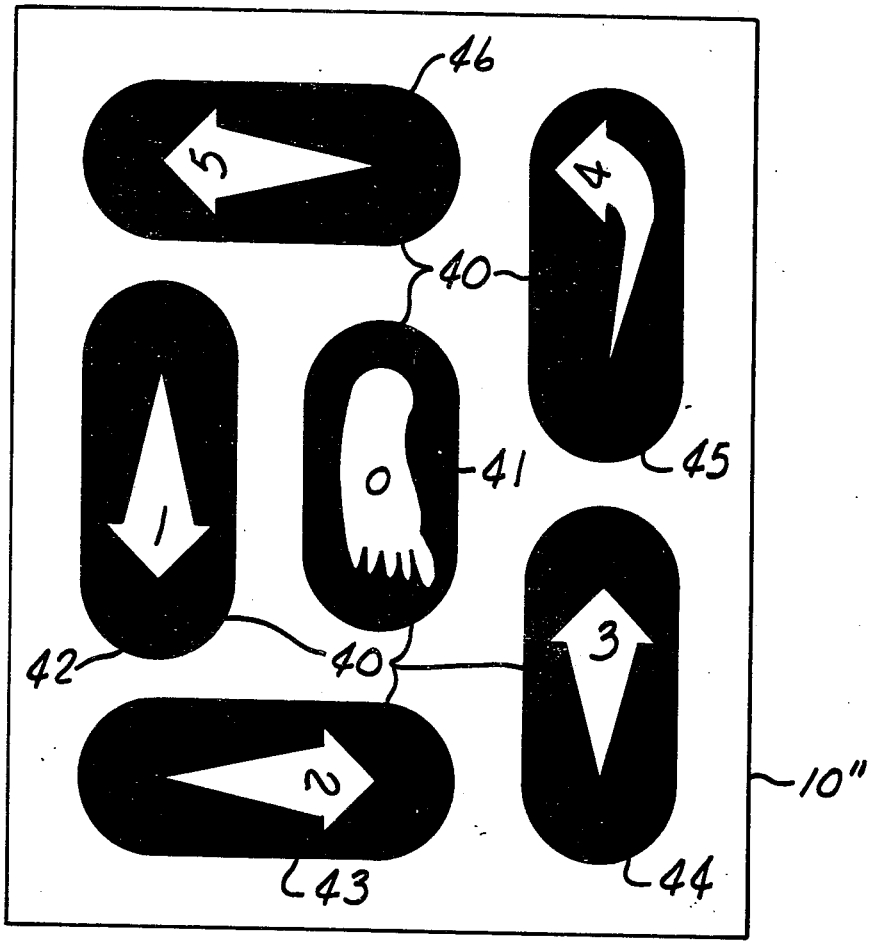
FIG. 9 is a plan view illustrating another embodiment of the boundary surface in which a game participant stands in the form of a map having imprinted areas thereon forming a plurality of different participant standing positions.

Referring next to FIG. 9, the standing boundary 10'' in this instance is illustrated as a thin fabric or plastic mat which has imprinted thereon a plurality of different participant standing positions 40. This mat or boundary adds additional fascination and enjoyment in playing the game of the present invention. The mat 10'' may be used in a number of different ways.

For example, if it is assumed that two players are participating in the game and each is provided with the mat 10'', the participants begin by positioning their respective left foot within position 41 and their respective right foot in position 42. The participants then play the game as before, and when one participant wins by causing his opponent to step off his foot boundary 41 or 42, then the winning participant leaves his left foot in position 41 and moves his right foot onto position 43.

His feet must remain in these boundaries. The losing participant still maintains his position with his feet respectively standing on positions 41 and 42.

If the previous winner continues to win by causing the opponent to step off either boundary 41 or 42, upon each win, the winner moves his right foot to the next successive right foot standing position 44, 45 and 46 respectively.

Each new standing position for the winner makes it more difficult for the winner to win the game and thus increases the required skill as the game progresses. The final winner of the game or match is the participant who manages to move his right foot through all five standing positions 42 through 46.

Of course, the procedure can also be reversed wherein the loser is required to move his left or right foot to a next succeeding position and the winner can thus be designated the participant who thus causes the opponent to move his right or left foot (as the case may be) through all positions 42 through 46 respectively.

I claim:

1. A game of physical skill to be played by at least two persons comprising a pair of spaced mats for participants to stand on and a hand line to be grasped by persons standing on said mats respectively, said mats imprinted with a plurality of different participant standing positions.

2. A game of physical skill to be played by at least two persons comprising a pair of spaced roller skate boards for participants to stand on and a hand line to be grasped by persons standing on said roller skate boards respectively.

3. The game of claim 2 including stop means to prevent said skate boards from rolling on a ground surface.

4. A game of physical skill to be played by at least two persons comprising a pair of spaced encompassing standing boundaries for a participant to stand within and a hand line to be grasped by persons standing within said boundaries respectively, and grip means for each participant slidably received over said hand line to grip the same by hand manipulation.

5. The game of claim 4 wherein said boundaries are mats.

6. The game of claim 4 wherein said boundaries are portable platforms capable of holding the weight of a human being a short distance off of a ground surface.

7. The game of claim 6 wherein said platforms are teetering platforms.

8. The game of claim 4 wherein said hand grip means is a flexible plastic tube.

9. The game of claim 4 wherein said hand grip means is a rigid tube.

10. The game of claim 4 wherein said hand grip means is a flexible tubing section and including a rigid tube section coaxially received over and secured to said flexible tube section.

11. The game of claim 4 including at least three of said spaced boundaries each positioned out of alignment with the remaining boundaries, said hand line consisting of a line segment for each of said boundaries with each of said line segments being joined together at one end at a point intermediate said spaced boundaries in each of said line segments having a length sufficient to reach its respective platform.

12. The game of claim 4 wherein each of said boundaries consists of a platform having a circular top having an annular perimetric and downwardly extending base to engage a ground surface, said top having a plurality of spaced downwardly extending indentations, the bottoms of which touch the ground surface.

13. The game of claim 12 wherein said platforms are integrally molded of plastic.

14. The game of claim 12 wherein said hand grip means is a flexible tubing section and including a rigid tube section coaxially received over and secured to said flexible tube section.

15. A game of physical skill to be played by at least two persons comprising a plurality of spaced encompassing standing boundaries for each game participant to stand within, a hand line having a plurality of free end hand line segments to be grasped respectively by each game participant, and a plurality of hand grip means slidably received over respective of said free end hand line segments as a hand line grip for each game participant.

16. The game of claim 15 wherein said boundaries are portable platforms capable of holding the weight of a human being a short distance off of a ground surface.

17. The game of claim 16 wherein said platforms are roller skate boards.

18. The game of claim 17 including stop means to prevent said skate boards from rolling on a ground surface.

19. The game of claim 16 wherein said platforms are teetering platforms.

20. The game of claim 15 wherein said hand grip means is a flexible tubing section.

21. The game of claim 15 wherein said hand grip means is a rigid tube section.

22. The game of claim 15 wherein said mats are imprinted with a plurality of different participant standing positions.

* * * * *